US005589099A

United States Patent [19]

Baum

[11] Patent Number: 5,589,099

[45] Date of Patent: Dec. 31, 1996

[54] LOW FOAMING RINSE AGENTS COMPRISING ETHYLENE OXIDE/PROPYLENE OXIDE BLOCK COPOLYMER

[75] Inventor: Burton M. Baum, Mendota Heights, Minn.

[73] Assignee: Ecolab Inc., St. Paul, Minn.

[21] Appl. No.: 49,973

[22] Filed: Apr. 20, 1993

[51] Int. Cl.[6] ..... C11D 1/66

[52] U.S. Cl. ..... 510/514; 510/221

[58] Field of Search ..... 252/174.15, 174.21, 252/108, 174.18

[56] References Cited

U.S. PATENT DOCUMENTS

| | | | |
|---|---|---|---|
| 4,618,446 | 10/1986 | Haslop et al. | 252/135 |
| 4,793,943 | 12/1988 | Haslop et al. | 252/135 |
| 4,871,467 | 10/1989 | Akred et al. | 252/135 |
| 5,045,225 | 9/1991 | Aronson et al. | 252/174 |
| 5,073,298 | 12/1991 | Gentle et al. | 252/358 |
| 5,133,892 | 7/1992 | Chun et al. | 252/90 |
| 5,152,933 | 10/1992 | Holland | 252/559 |

FOREIGN PATENT DOCUMENTS

| | | |
|---|---|---|
| 0000216 | 1/1979 | European Pat. Off. . |
| 0182461 | 5/1986 | European Pat. Off. . |
| 1807782 | 6/1979 | Germany . |
| 49-126703 | 12/1974 | Japan . |
| 50-62211 | 5/1975 | Japan . |
| 51-68608 | 6/1976 | Japan . |
| 86-131272 | 6/1986 | Japan . |
| 86-161193 | 7/1986 | Japan . |
| 59-187096 | 6/1990 | Japan . |

OTHER PUBLICATIONS

"Rinse Additives for Machine Dischwashing", Wilson et al., *Soap and Chemical Specialties,* pp. 48 et seq. (Feb. 1958).

*Primary Examiner*—Asok Pal
*Assistant Examiner*—E. D. Irzinski
*Attorney, Agent, or Firm*—Merchant, Gould, Smith, Edell, Welter & Schmidt

[57] ABSTRACT

Ethylene oxide/propylene oxide block copolymers having high cloud points, when compared to conventional rinse agent materials, have surprisingly been found to be useful in the manufacture of effective low foaming rinse aids. The rinse aids are prepared by combining the high cloud point copolymer with an effective defoamer and a water miscible diluent. The rinse aid composition can achieve adequate rinsing at common aqueous rinse temperatures at a concentration of the block copolymer in water less than 500 parts of the block copolymer per million parts of water. A liquid rinse agent concentrate can take the form of a low viscosity liquid, a thickened pourable or semi-pourable aqueous liquids. A solid rinse agent concentrate can be a cast solid material packaged within a soluble or disposable wrapper or capsule or other water soluble package. The rinse aids can be dispersed in a variety of ways by dilution with water to an aqueous final rinse composition. The uniqueness of the invention relates to the fact that all components are not expected to be active as sheeting agents and are approved as food additives thereby eliminating any health concerns associated with residual deposits of the composition on cleaned ware.

19 Claims, No Drawings

LOW FOAMING RINSE AGENTS COMPRISING ETHYLENE OXIDE/PROPYLENE OXIDE BLOCK COPOLYMER

FIELD OF THE INVENTION

The invention relates to warewashing processes and chemicals used in washing cookware, dishware and flatware. More particularly, the invention relates to primarily organic materials that can be added to water to promote a sheeting action in an aqueous rinse used after an alkaline detergent cycle. Such aqueous rinse aids promote effective sheeting to result in removal of aqueous rinse materials and solids contained therein from cookware, dishware and flatware and are low foaming and non-toxic. A decidedly added benefit is to have the rinse aid composed of materials that are approved as additives to food.

BACKGROUND OF THE INVENTION

Mechanical warewashing machines have been common in the institutional and household environments for many years. Such automatic warewashing machines clean dishes using two or more cycles which can include initially a wash cycle followed by a rinse cycle. Such dishwashers can also utilize soak cycle, prewash cycle, scrape cycle, second wash cycle, a rinse cycle, a sanitizing cycle and a drying cycle, if required. Such cycles can be repeated if needed and additional cycles can be used. After passing through a wash, rinse and dry cycle, dishware, cups, glasses, etc., can exhibit spotting that arises from the uneven draining of the water from the surface of the ware after the rinse step. Spotting is aesthetically unacceptable in most consumer and institutional environments.

In order to substantially prevent the formation of spotting rinse agents have commonly been added to water to form an aqueous rinse which is sprayed on the dishware after cleaning is complete. The precise mechanism through which rinse agents work is not established. One theory holds that the surfactant in the rinse aid is absorbed on the surface at temperatures at or above its cloud point, and thereby reduces the solid-liquid interfacial energy and contact angle. This leads to the formation of a continuous sheet which drains evenly from the surface and minimizes the formation of spots. Generally, high foaming surfactants have cloud points above the temperature of the rinse water, and, according to this theory, would not promote sheet formation, thereby resulting in spots. Moreover, high foaming materials are known to interfere with the operation of the warewashing machine. Common rinse aid formulas are used in an amount of less than about 1,000 parts preferably less than 500 parts, commonly 50 to 200 parts per million of active materials in the aqueous rinse. Rinse agents available in the consumer and institutional markets comprise liquid or solid forms which are typically added to, dispersed or dissolved in water to form an aqueous rinse. Such dissolution can occur from a rinse agent installed onto the dish rack. The rinse agent can be diluted and dispensed from a dispenser mounted on or in the machine or from a separate dispenser that is mounted separately but cooperatively with the dish machine.

Many rinse agents comprise a polyalkylene oxide copolymer preferably ethylene oxide/propylene oxide block copolymer. In such materials, the ethylene oxide block tends to be hydrophilic while the propylene oxide blocks tend to be hydrophobic producing a separation of hydrophilic and hydrophobic groups on the surfactant molecule. Those skilled in the art of formulating nonionic based rinse agents have formed a belief that an EO/PO block copolymer must have a cloud point (measured in a 1 wt-% aqueous solution) substantially less than the use temperature of the aqueous rinse and exhibit good wetting properties to obtain sheeting. Such belief is borne out in a review of promotional material related to low cloud point block copolymers. Block copolymers suggested for use in aqueous rinse aids typically comprise low molecular weight (less than about 5,000) and display low cloud points (less than about 40° C. using a 1 wt-% aqueous solution). The common belief in the rinse aid art is that high cloud point, high molecular weight block copolymers would not exhibit good sheeting properties and would have substantial foaming problems. Further, a substantial need has arisen for environmentally compatible rinse agent compositions. Rinse additives are well known to the trade and have been in use for thirty or more years. However there is an unmet need for rinse additives that are made entirely of food additive materials. Formulation of successful compositions using the limited range of materials approved as food additives is a very challenging situation since using only food additive materials greatly limits what can be used in the formulation. Further, such formulations are very unique in that few combinations will work.

Surprisingly, we have found that high molecular weight, high cloud point materials can be effectively defoamed with effective food additive defoamer materials to form rinse additives which yield desirable continuous sheets on the ware and provide an extra degree of safety if they leave any residue on the cleaned ware. In our research on developing rinse agents, we find that the nonionic agents of the invention are surprisingly good sheeting agents even though they have high cloud points and generate significant volumes of foam in use. Those skilled in the art find that surfactants in rinse aids require both effective wetting agent properties and low foaming properties. Traditionally, rinse agents contain nonionic surfactants with relatively low cloud points since these materials exhibit little foam above the cloud point. The nonionics of the invention have cloud points above 100° C. measuring a 1 wt-% aqueous solution and were consistently considered to be poor candidates for rinse agents because high cloud points indicate poor sheeting properties. However, we have found surprisingly that although these materials foam significantly, they have acceptable sheeting properties at approximately 200 parts, preferably 100 parts, of the nonionic polyether per million parts of rinse composition. Moreover, we have found that the use of certain classes of defoamers in combination with the nonionics of the invention yield rinse agent materials with very low foaming properties that perform very well in sheeting tests. We have found food additive defoamers that can be combined with food additive nonionic block copolymer materials. Most high foaming nonionic materials are generally hydrophilic and quite water soluble. On the other hand, adequate defoaming materials tend to be quite hydrophobic. Hydrophilic and hydrophobic materials are generally incompatible at high concentrations in a concentrated form. In many warewashing apparatus, defoaming materials are often added directly to the rinse aid or other aqueous compositions at the point of use. The defoamer not only suppresses the foaming nature of the high cloud point nonionic material but appears to make the nonionic material behave like the low cloud point material in forming an evenly draining, continuous film. This property of the combination is unexpected. The rinse agents can be diluted to form an effective aqueous rinse with a water miscible aqueous diluent. The rinse agents of the invention can also take the form of a liquid rinse agent or a cast solid rinse agent material.

Haslop et al., U.S. Pat. No. 4,618,446, teaches a variety of ingredients for use in spherical liquid detergent compositions.

Haslop et al., U.S. Pat. No. 4,793,943, teaches a variety of ingredients useful for making liquid detergent compositions.

Akred et al., U.S. Pat. No. 4,871,467, teaches a variety of compositions and materials used to form non sedimenting liquid detergent compositions.

Aronson et al., U.S. Pat. No. 5,045,225, teaches a combination of hydrocarbon oils and silicone compositions as antifoam materials.

Gentle et al., U.S. Pat. No. 5,073,298, teaches silicone silicate based defoaming compositions.

Chun et al., U.S. Pat. No. 5,133,892, teaches machine dishwashing detergent tablets having timed release of enzyme and chlorine bleach and a variety of other ingredients used in making the detergent composition.

Tsukada, Japanese Patent Application Publication Kokai 49-126,703, teaches carbohydrate aliphatic ester rinse agents.

Miura et al., Japanese Patent Application Publication Kokai 50-62,211, teaches polyhydric alcohol containing rinse agents.

Miura et al., Japanese Patent Application Publication Kokai 51-68,608, teaches polyol aliphatic ester containing rinse agent compositions.

Suzuki et al., Japanese Patent Application No. 86-131, 272, teaches a rinse agent comprising a polyethoxylated sorbitan fatty acid ester glycerol and a sugar alcohol.

Suzuki et al., Japanese Patent Application No. 86-161, 193, teaches a similar material.

Nantaku, Japanese Patent Application No. 59-187,096, teaches a polyglycerine ester of a $C_{6-8}$ fatty acid containing rinse agent.

Wilson et al., "Rinse Additives for Machine Dishwashing", *Soap and Chemical Specialties,* pp 48 et seq. (February 1958), discusses the basic technology regarding rinse agent formulation.

None of the prior art material combine the preferred high cloud point, high foaming surfactants with an appropriate defoamer to achieve a rinse agent that can be diluted into an aqueous rinse providing low foaming sheeting properties.

BRIEF DISCUSSION OF THE INVENTION

The invention resides in part in a concentrated, low foaming, effective rinse agent composition formulated from food additive components which can take the form of a dilutable liquid, gel or solid concentrate. The minimum requirement for a concentrated rinse agent is effective sheeting action and low foam in an aqueous rinse. Such concentrate materials may contain a nonionic block copolymer and a defoamer composition to provide basic rinse requirements. Such materials can contain an ethylene oxide-propylene oxide nonionic block copolymer with a high cloud point. The nonionic block copolymer can commonly comprise compounds produced by polymerizing ethylene oxide and propylene oxide.

Illustrative but non-limiting examples of various suitable high cloud point nonionic surface active agents for the rinse agents of this invention include polyoxyethylene-polyoxypropylene block copolymers having the formula:

$$(EO)_x(PO)_y(EO)_z$$

wherein x, y and z reflect the average molecular proportion of each alkylene oxide monomer in the overall block copolymer composition. x typically ranges from about 30 to 130, y typically ranges from about 30 to 70, z typically ranges from about 30 to 130, and x plus y is typically greater than about 60. The total polyoxyethylene component of the block copolymer constitutes typically at least about 40 mol-% of the block copolymer and commonly 75 mol-% or more of the block copolymer. The material preferably has a molecular weight greater than about 5,000 and more preferably greater than about 10,000.

An important characteristic of the nonionic block copolymers used in the rinse agents of the invention is the cloud point of the material. The cloud point of nonionic surfactant of this class is defined as the temperature at which a 1 wt-% aqueous solution of the surfactant turns cloudy when it is heated.

BASF, a major producer of nonionic block copolymers in the United States recommends that rinse agents be formulated from nonionic EO-PO sheeting agents having both a low molecular weight (less than about 5,000) and having a cloud point of a 1 wt-% aqueous solution less than the typical temperature of the aqueous rinse. The prevailing understanding of the skilled artisan in this area is that a nonionic surfactant with a high cloud point or high molecular weight would either produce unacceptable foaming levels or fail to provide adequate sheeting capacity in a rinse aid composition.

As disclosed in the BASF literature, wetting ability is another important factor in choosing a block copolymer as a rinse aid. Good wetting properties lead to spot and film free glassware, "wetting increases with increasing hydrophobe molecular weight and decreasing hydrophile weight." The block copolymer of this invention are highly hydrophilic and not considered good wetting agents. They would not, consequently, be considered good candidates for rinse additives. The uniqueness of the invention relates to the fact that all components are not expected to be active as sheeting agents and are approved as food additives thereby eliminating any health concerns associated with residual deposits of the composition on cleaned ware.

There are two general types of rinse cycles in commercial warewashing machines. A first type, a sanitizing rinse cycle, uses rinse water at about 180° F. (about 80° C.). A second type in non-sanitizing machines use lower temperature non-sanitizing rinse water. Typically, the temperature of the service water available, from the water heaters installed at the use location, is about 125° F. (about 50° C.), 140° F. (about 60° C.), 160° F. (about 70° C.), etc. A surfactant useful in any of these use locations is an aqueous rinse having a cloud point greater than the available hot service water. Accordingly, the lowest useful cloud point, measured using a 1 wt-% aqueous solution, for the nonionics of the invention point is approximately 40° C. The cloud point can be 60° C., 70° C., 80° C. or 90° C., depending on the use locus water temperature.

For the purpose of this invention, the term "rinse agent" includes concentrate materials that are diluted with an aqueous stream to produce an aqueous rinse. Accordingly, an aqueous rinse agent is an aqueous material that is contacted with ware in a rinse cycle. A sheeting agent is the polymeric material used to promote the even drainage of the aqueous rinse. Sheeting is defined as forming a continuous, evenly draining film, leaving virtually no spots or film upon the evaporation of water. For the purpose of this invention, the term "dish" or the term "ware" is used in the broadest sense of the term to refer to various types of articles used in the preparation, serving, consumption, and disposal of food stuffs including pots, pans, trays, pitchers, bowls, plates, saucers, cups, glasses, forks, knives, spoons, spatulas, and other glass, metal, ceramic, plastic composite articles commonly available in the institutional or household kitchen or dining room.

Defoaming agents (defoamers) include a variety of different materials adapted for defoaming a variety of compositions. Defoamers can comprise an anionic or nonionic material such as polyethylene glycol, polypropylene glycol, fatty acids and fatty acid derivatives, fatty acid sulfates, phosphate esters, sulfonated materials, silicone based compositions, and others.

Preferred defoamers are food additive defoamers including silicones and other types of active anti-foam agents. For the purposes of this application, the term "food additive" means materials listed in the U.S. Code of Federal Regulations 21 Part 172—Food Additives Permitted for Direct Addition to Food for Human Consumption, 21 Part 182—Substance Generally Recognized as Safe and 21 Part 184—Direct Food Substances Affirmed as Generally Recognized as Safe, and 21 Part 173—Secondary Direct Food Additives Permitted in Food for Human Consumption, Section 173.310—Defoaming Agents.

Silicone foam suppressors include polydialkylsiloxane preferably polydimethylsiloxane. Such silicone based foam suppressors can be combined with silica. Such silica materials can include silica, fumed silica, derivatized silica, silanated silica, etc. Commonly available anti-foaming agents combines a polydimethylsiloxane and silica gel. Another food additive defoaming agent comprises a fatty acid defoamer. Such defoamer compositions can comprise simple alkali metal or alkaline earth metal salts of a fatty acid or fatty acid derivatives. Examples of such derivatives include mono, di- and tri- fatty acid esters of polyhydroxy compounds such as ethylene glycol, glycerine, propylene glycol, hexylene glycol, etc. Preferably such defoaming agents comprise a fatty acid monoester of glycerol. Fatty acids useful in such defoaming compositions can include any $C_{8-24}$ saturated or unsaturated, branched or unbranched mono or polymeric fatty acid and salts thereof, including for example myristic acid, palmitic acid, stearic acid, behenic acid, lignoceric acid, palmitoleic acid, oleic acid, linoleic acid, arachidonic acid, and others commonly available. Other food additive anti-foam agents available include water insoluble waxes, preferably microcrystalline wax, petroleum wax, synthetic petroleum wax, rice base wax, beeswax having a melting point in the range from about 35° to 125° C. with a low saponification value, white oils, etc. Such materials are used in the rinse agents of the invention at a sufficient concentration to prevent the accumulation of any measurable stable foam within the dish machine during a rinse cycle.

The food grade rinse aid composition of the invention can contain one or more solid water soluble food grade fillers for the purpose of facilitating processing, product stability, or dispensing of the composition or contributing to other performance characteristics. Many different types of fillers may be utilized in the rinse agent composition, including specifically but not limited to such compounds as a sugar such glucose, fructose, sucrose; an alkali metal salt such as sodium chloride, potassium chloride, sodium carbonates, sodium bicarbonate, sodium sulfate, potassium sulfate, sodium acetate, sodium lactate, water soluble amino acids such as alanine, arginine, glycine, lysine, proline; phosphates such as tetrasodium pyrophosphate, sodium phosphate and others.

The rinse agents of the invention can contain a complexing or chelating agent that aids in reducing the harmful effects of hardness components in service water. Typically calcium, magnesium, iron, manganese, and other polyvalent metal cations, present in service water, can interfere with the action of either washing compositions or rinsing compositions. A chelating agent can effectively complex with and prevent such ions from the service water interfering with the action of an active component increasing rinse agent performance. Both organic and inorganic chelating agents are common. Inorganic chelating agents include such compounds as sodium pyrophosphate, and sodium tripolyphosphate. Organic chelating agents include both polymeric and small molecule chelating agents. Polymeric chelating agents commonly comprise ionomer compositions such as polyacrylic acids compounds. Small molecule organic chelating agents include salts of ethylenediaminetetracetic acid (EDTA) and hydroxyethylenediaminetetracetic acid, nitrilotriacetic acid, ethylenediaminetetrapropionates, triethylenetetraminehexacetates, and the respective alkali metal ammonium and substituted ammonium salts thereof. Aminophosphates are also suitable for use as chelating agents in the composition of the invention and include ethylenediamine tetra(methylenephosphonates), nitrilotrismethylenephosphonates, diethylenetriaminepenta(methylene phosphonates). These amino phosphonates commonly contain alkyl or alkylene groups with less than 8 carbon atoms. Preferred chelating agents for this invention include approved food additive chelating agents such as the disodium salt of ethylenediaminetetracetic acid.

The liquid rinse agent compositions of the invention have a liquid base component which functions as a carrier and cooperates with aqueous diluents to form the aqueous rinse. Liquid bases are preferably water or a solvent compatible with water to obtain compatible mixtures thereof. Exemplary nonlimiting solvents in addition to water include a low molecular weight $C_{1-6}$ primary and secondary mono, di- and tri- hydroxy alcohol such as methanol, ethanol, isopropanol, and polyols containing from two to six carbon atoms and from two to six hydroxyl groups such as propylene glycol, ethylene glycol, glycerine, propane diol, propylene glycol, etc.

The organic nature of the rinse agents of the invention can be subject to microbial and chemical decomposition. Organic materials are commonly useful in stabilizing the mixtures. Preferred preservatives or stabilizers for the invention include food grade stabilizers, food grade antioxidants, et cetera. Most preferred materials for use in stabilizing the compositions of the invention include $C_{1-10}$ mono, di- and tricarboxylic acid compounds. Preferred examples of such acids include acetic acid, citric acid, benzoic, sorbic, lactic, maleic, tartaric and fumaric.

Optional ingredients which can be included in the rinse agents of the invention in conventional levels for use include solvents, hydrotropes, processing aids, corrosion inhibitors, dyes, fillers, optical brighteners, germicides, pH adjusting agents (monoethanolamine, sodium carbonate, sodium hydroxide, hydrochloric acid, phosphoric acid, et cetera), bleaches, bleach activators, perfumes and the like.

The compositions of the invention can be formulated using conventional formulating equipment and techniques. The compositions of the invention typically can comprise proportions as set forth in Table I.

In the manufacture of the liquid rinse agent of the invention, typically the materials are manufactured in commonly available mixing equipment by charging to a mixing chamber the liquid diluent or a substantial proportion of a liquid diluent. Into a liquid diluent is added preservatives or other stabilizers. Care must be taken in agitating the rinse agent as the formulation is completed to avoid degradation of polymer molecular weight or exposure of the composition to elevated temperatures. The materials are typically agitated until uniform and then packaged in commonly available packaging and sent to distribution center before shipment to the consumer.

TABLE I

| | Liquid Rinse Agent Proportions | | |
|---|---|---|---|
| | Useful | Preferred | Most Preferred |
| Nonionic Sheeting Agent | 0.1–50 | 5–40 | 10–30 |
| Defoamer | 0.1–30 | 0.2–25 | 1–15 |
| Thickener | 0–5 | 0–4 | 0.1–1 |
| Preservative | 0–1 | 0.01–0.5 | 0.025–0.2 |
| Diluent | Balance | Balance | Balance |

The liquid materials of the invention can be adapted to a cast solid format by incorporating into the composition a casting agent. Typically organic and inorganic solidifying materials can be used to render the composition solid. Preferably organic materials are used because inorganic compositions tend to promote spotting in a rinse cycle. The most preferred casting agents are polyethylene glycol and an inclusion complex comprising urea and a nonionic polyethylene or polypropylene oxide polymer. Polyethylene glycols (PEG) are used in melt type solidification processing by uniformly blending the sheeting agent and other components with PEG at a temperature above the melting point of the PEG and cooling the uniform mixture. An inclusion complex solidifying scheme is set forth in Morganson et al., U.S. Pat. No. 4,647,258.

The solid compositions of the invention are set forth in Table II as follows:

TABLE II

| | Solid Rinse Agent Proportions (wt-%) | | |
|---|---|---|---|
| | Useful | Preferred | Most Preferred |
| Nonionic Sheeting Agent | 0.1–50 | 5–40 | 10–30 |
| Defoamer | 0.1–30 | 0.2–25 | 1–15 |
| Thickener | 0–5 | 0–4 | 0.1–1 |
| Preservative | 0.001–1 | 0.01–0.5 | 0.025–0.2 |
| Solidifying System | 0–25 | 0.1–15 | 0.5–0 |
| Diluent | Balance | Balance | Balance |

Liquid rinse agents of the invention are typically dispensed by incorporating compatible packaging containing the liquid material into a dispenser adapted to diluting the liquid with water to a final use concentration wherein the active material is present in the aqueous rinse at a concentration of 20 to 500 parts of the active block copolymer per million parts of the aqueous rinse. More preferably the material is present in the aqueous rinse at a concentration of about 30 to 300 parts of the block copolymer per million parts of the aqueous rinse most preferably the material is present at a concentration of about 40 to 200 parts of the block copolymer per million parts of the aqueous rinse. Examples of dispensers for the liquid rinse agent of the invention are DRYMASTER-P sold by Ecolab Inc., St. Paul, Minn. Cast solid products may be conveniently dispensed by inserting a cast solid material in a container or with no enclosure into a spray-type dispenser such as the volume SOL-ET controlled ECOTEMP Rinse Injection Cylinder system manufactured by Ecolab Inc., St. Paul, Minn. Such a dispenser cooperates with a warewashing machine in the rinse cycle. When demanded by the machine, the dispenser directs a spray of water onto the cast solid block of rinse agent which effectively dissolves a portion of the block creating a concentrated aqueous rinse solution which is then fed directly into the rinse water forming the aqueous rinse. The aqueous rinse is then contacted with the dishes to affect a complete rinse. This dispenser and other similar dispensers are capable of controlling the effective concentration of the active block copolymer in the aqueous rinse by measuring the volume of material dispensed, the actual concentration of the material in the rinse water (an electrolyte measured with an electrode) or by measuring the time of the spray on the cast block.

The following examples and data further illustrate the practice of the invention, should not be taken as limiting the invention and contains the best mode. The following examples and data show the effectiveness of the invention in promoting adequate rinsing and shows that the claimed defoamers in cooperation with the claimed nonionic block copolymers with a high cloud point in combination provide effective rinsing and sheeting action on dishware when used. Further, the data show a variety of well-known defoamers in combination with the block copolymers of the invention fail to provide defoaming and sheeting action.

EXAMPLE 1

Into an appropriately sized glass beaker equipped with a mechanical mixer is placed 85 parts of filtered deionized water. Agitation is begun and to the beaker is added about 13 parts by weight of a nonionic, $EO_xPO_yEO_z$ (wherein x is 128, y is 54 and z is 128) surfactant having a cloud point of greater than about 100° C. (Pluronic F108) slowly, until dissolution is complete. Then into the nonionic solution is added two parts by weight of sodium oleate. The mixture is agitated until uniform. The final pH was 8.6.

EXAMPLE 1A

Using the procedure of Example 1, the following formulation was prepared using a nonionic surfactant (Pluronic F108) having a cloud point of >100° C. at 13.0 wt-%. A polydimethylsiloxane/silica defoamer at 6.5 wt.-% 1.3% active, a xanthan thickener at 0.25 wt.-%, benzoic acid at 0.05 wt.-%, sorbic acid 0.10 wt.-5, tap water 80.10 wt.-%. Final pH 3.6 (adjusted with HCl).

EXAMPLES 2A AND B

Into a suitably sized glass beaker equipped with a mechanical mixer was placed approximately ten parts of tap water. Agitation was begun and into the water was added a polydimethylsiloxane/silica defoamer. The mixture was agitated until smooth. Into a separate appropriately sized glass beaker was added about 70 parts of tap water at 120° F. Into the water was placed slowly with stirring 13 parts of a nonionic block copolymer (Pluronic F108). The uniform material was cooled and the silicone emulsion prepared above was mixed slowly into the nonionic aqueous solution to form the finished rinse aid. The table III following contains the proportions of the materials used.

TABLE III

| | 2A | 2B |
|---|---|---|
| Pluronic F108 | 13 | 13 |
| Silicone Silica/ Defoamer | 3.3 | 6.5 |
| Distilled water | 83.7 | 80.5 |

Using the procedure of Example 1, the compositions set forth in the following table IV were prepared.

The sheeting test data presented in the following Tables were obtained using a Champion 1-KAB machine dishwasher having wash and rinse temperatures of about 160° F. Test pieces were placed in the machine having a glass door so that they could be observed during the rinse cycle. For the evaluation, the test pieces were washed in soft water three times on automatic cycle using 200 grams of an alkaline detergent prepared by blending 30 wt-% sodium metasilicate, 35% sodium tripolyphosphate, 3 wt-% Plurafac® surfactant No. RA-43, and 32% sodium carbonate. During the three wash cycles no rinse additive was used. To determine the sheeting effect, the machine was filled with water and set on manual. Into the water was added 2000 parts of a 2:1 mixture of margarine and non-fat milk per million parts of rinse water, and a minimum measured amount of the tested rinse composition. The mixture was circulated for 3 minutes and the concentration of rinse additive was progressively increased by injecting increasing amounts of rinse composition until a substantially continuous sheeting effect of the rinse water was noted over substantially all the test pieces. The minimum concentration for continuous sheeting was noted and recorded in the tables of data.

TABLE IV

SHEETING RESULTS WITH NONIONIC FOOD ADDITIVE SURFACTANTS 1 KAB MACHINE, CITY WATER

| RAW MATERIAL | TEMP, F. | SHEETING (Conc. ppm(a)) | SHEETING Type (b) | FOAM (Inch) |
|---|---|---|---|---|
| | | RAW MATERIALS (c) | | |
| F108 | 165 | 150 | P | 1.0 |
| F127 | 160 | 175 | P/C | 1.5 |
| | | FORMULATIONS (d) | | |
| F108 (15%) | 160 | 175 | P/C | 1.25 |
| F108 (11.1%)/ Dioctyl Sodium Sulfosuccinate (5.2%)/ Propylene Glycol (15.4%) | 164 | 125 | P | 3.0 |
| F127 (15%)/ Dioctylsodium Sulfosuccinate (1.5%) | 161 | 150 | P | 2.5 |
| F108 (15%)/ Lactic Acid (15%) | 164 | 225 | C/P | 1.25 |
| F108 (15%)/ Lactic Acid (10%) | 159 | 150 | P/C | 1.5 |
| F108 (15%)/ Lactic Acid (1%) | 164 | 150 | C/P | 1.25 |
| F108 (15%)/ Sod Oleate (2%) | 166 | 100 | P | TRACE |

TABLE IV-continued

SHEETING RESULTS WITH NONIONIC FOOD ADDITIVE SURFACTANTS 1 KAB MACHINE, CITY WATER

| RAW MATERIAL | TEMP, F. | SHEETING (Conc. ppm(a)) | SHEETING Type (b) | FOAM (Inch) |
|---|---|---|---|---|
| F108 (13%)/ 1520 US (6.5%) | 167 | 125 | P | TRACE |

(a) ppm of active components to give sheeting on all substrates;
(b) P = pinhole, C = complete, P/C = mixed;
(c) Materials tested without pre-dilution or formulation; (d) Rest of formulation consists of water.

The foaming data recorded in the Tables entitled *Dynamic Foam Test* was generated in a foam test device which is a cylindrical container 8 liters in volume, 15 centimeters in diameter and 50 centimeters in height equipped with an electric hot plate for temperature control, and a pump to recirculate the test solution at 6 psi via a means to direct a spray of the test solution onto the surface of the contents of the solution to generate foam. The rinse aid formulations were added to the water at 160° F. to give a concentration of 100 ppm of sheeting agent. The foam heights were determined after 1 and 5 minutes of circulation. The persistence or stability of the foam was also noted. An unstable foam designated by the letter U, collapsed when the pumping was stopped. Foam heights less than 3" inches and unstable foam production are preferred. The data in the Tables demonstrate that the high cloud point nonionic surfactants can attain sufficient sheeting properties to provide adequate rinsing of tableware, flatware, etc. at reasonable concentrations between about 100 and 200 parts of the surfactant per million parts of an aqueous rinse material. These sheeting properties can be attained at reasonable operating temperatures and when used with a defoamer can prevent the generation of stable foam or generation of high levels of foam. The Pluronic F108 formulations with defoamers exhibited acceptable or no foam properties.

TABLE V

| | Dynamic Foam Test 1 | 2 | 3 | 4 |
|---|---|---|---|---|
| Pluronic F108 (BASF) | 13.0 | 13.0 | 13.0 | 13.0 |
| 1520 US[1] (20% Active) | 6.5 | 6.5 | — | — |
| Keltrol RD[2] | 0.25 | 0.5 | 0.5 | 0.5 |
| Benzoic Acid | 0.05 | 0.05 | 0.05 | 0.05 |
| Sorbic Acid | 0.1 | 0.1 | 0.1 | 0.1 |
| Water, Tap, City | 80.1 | 79.85 | 73.25 | 81.95 |
| FG 10[1] (10% Active) | | | 13.2 | |
| AF[1] (30% Active) | | | | 4.4 |
| pH 4.0 | | | | |

Dynamic Foam Test - All At 100 ppm active, 2.3 gm/31.
160° F. 6 psi.
City Water
1 min = ½" U[3]
1- 5 min = ¾" U
1 min = ½" U
2- 5 min = ¾" U
1 min = ¾" U
3- 5 min = 1½" U
1 min = ¾" U
4- 5 min = 1¼" U
[1]Polydimethylsiloxane defoamer; Dow Corning
[2]Xanthan gum, Kelco
[3]U = Unstable The examples and data in Table V show that the nonionic surfactant material can be combined with silicone defoamers, available xanthan thickeners, stabilizing agents and other materials and can be diluted to form a useful rinse aid material. The rinse aid can be diluted with water to form an aqueous rinse that can be used without the generation of substantial quantities of foam.

machine to provide excellent sheeting and low foaming at high temperature on a variety of ware surfaces including china, melamine plastic, glass and stainless steel tableware.

The following tables of data further display the excellent low foam characteristics of the rinse agents of the invention.

TABLE VI

HIGH TEMP RINSE ADDITIVE SHEETING TEST
Pluronic F108 - 13%
1520 US - 6.5%
Keltrol RD - 0.25%

| PPM[1] | Temp | China Plate | Melamine Plate | Glass Tumbler | Glass Slide | Stainless Steel Knife | Stainless Steel Slide | Foam Inches |
|---|---|---|---|---|---|---|---|---|
| 50 | 160° | — | — | — | — | — | — | — |
| 75 | 160° | C | C | — | C | P | P | — |
| 100 | 161° | C | C | C | C | C | C | Trace |

[1]Of Pluronic F108
CONDITIONS:
Champion 1KAB machine
Water: Soft (8 ppm hardness)
KEY:
— No Sheeting
P Pinhole Sheeting
C Complete Sheeting The data in Table VI demonstrates that a rinse aid containing the nonionic sheeting agent, a silicone defoamer, and an available thickener can be combined to form a single phase useful rinse aid. The rinse aid can be diluted with soft water and can be used in a common automatic warewashing

TABLE VII

Dynamic Foam Tests - Pluronic F108/Siliconc Formulations

| | CONCENTRATION, %(a) | | | | | | | | | | | | | |
|---|---|---|---|---|---|---|---|---|---|---|---|---|---|---|
| F108 | 14 | 15 | 15 | 13 | 13 | 13 | 13 | 13 | 13 | 13 | 13 | 13 | 13 | 13 |
| SOD OLEATE | | | | | 2 | 2 | 2 | 2 | | | | | | |
| SAG 770(d) | (30% Active) | 0.4 | 1.5 | 4.5 | 4.5 | | | | | | | | | |
| 1520 US(d) | (20% Active) | | | | | 1.7 | 3.3 | 6.5 | 3.3 | 6.5 | | | | |
| FG-10(d) | (10% Active) | | | | | | | | | | 6.6 | 13.2 | | |
| AF(d) | (30% Active) | | | | | | | | | | | | 2.2 | 4.4 |
| Silicone Defoamer ppm(b) | 0 | 1 | 3 | 10 | 10 | 3 | 5 | 10 | 5 | 10 | 5 | 10 | 5 | 10 |
| | FOAM HEIGHT, INCHES (STABILITY)(c) | | | | | | | | | | | | | |
| | | | | | CITY $H_2O$ | | | | | | | | | |
| 1 MINUTE | 9.5(S) | 6.0(S) | 4.0(P) | 1.75(U) | 1.5(P) | 1.5(P) | 0.75(U) | 0.5(U) | 0.75(U) | 0.75(U) | 1.5(U) | 0.75(U) | 1.5(U) | 0.75(U) |
| 5 MINUTES | 11.5(S) | 9.5(S) | 8.5(P) | 5.25(P) | 2.25(U) | 5.0(U) | 2.0(U) | 1.0(U) | 3.25(U) | 0.75(U) | 5.0(U) | 1.5(U) | 3.0(U) | 0.75(U) |
| | | | | | SOFT $H_2O$ | | | | | | | | | |
| 1 MINUTE | | | | 2.0(U) | 1.25(P) | | 1.0(U) | | 1.0(U) | 0.75(U) | | | 2.0(U) | 0.75(U) |
| 5 MINUTES | | | | 5.5(P) | 3.0(U) | | 1.25(U) | | 3.5(U) | 1.0(U) | | | 4.5(U) | 1.0(U) |

(a)Rest of formula consists of water;
(b)Level of active silicone defoamer in system at use level of 100 ppm F108;
(c)160° F., 6 psi, 100 ppm active sheeting agent, S = stable, U = unstable, P = partially stable foam
(d)All polydimethylsiloxane defoamers. 1520 US, FG-10, AF supplied by Dow Corning; SAG770 supplied by Union Carbide The examples and the foam test data of Table VIII demonstrate that a stable single phase rinse aid can be manufactured from the nonionic material oleate and silicone base defoamers. Such rinse aids can be diluted with water to form an aqueous rinse that can provide acceptable sheeting and low foaming properties in city and soft water. The data shows the combination of a silicone and a oleate base defoamer is particularly good in defoaming the Pluronic nonionic materials.

While the above description, examples and data provides a basis for understanding the invention, the invention can be made in a variety of embodiments. The invention resides in the claims hereinafter appended.

We claim:

1. A food grade rinse agent composition comprising approved food additive ingredients, suitable for dilution to form an aqueous rinse, the composition comprising:

(a) about 5 to 40 wt-% of a nonionic block copolymer composition, comprising ethylene oxide and propylene oxide, having a molecular weight between 10,000 and 15,000 and a cloud point, measured using a 1 wt-% aqueous solution, greater than 100 ° C.;

(b) about 0.2 to 25 wt-% of a food additive defoamer composition; and (c) up to about 95 wt-% of a water soluble diluent composition.

2. The composition of claim 1 wherein the composition is a liquid concentrate comprising 60 to 95 wt-% water.

3. The composition of claim 1 wherein the nonionic block copolymer has the formula:

$$(EO)_x-(PO)_y-(EO)_z$$

wherein x is 30 to 130, y is 15 to 70, z is 30 to 130 and x+y is ≧60.

4. The composition of claim 1 wherein the defoamer comprises a silicone defoamer.

5. The composition of claim 4 wherein the silicone defoamer comprises a combination polydimethylsiloxane and silica at a ratio of about 5 to 100 parts by weight of a polydimethylsiloxane per each part by weight of silica.

6. The composition of claim 1 wherein the defoamer comprises a fatty acid defoamer.

7. The composition of claim 6 wherein the fatty acid aleroamer comprises a fatty acid ester of glycerol.

8. The composition of claim 7 wherein the fatty acid ester is a mono fatty acid ester of glycerol.

9. The composition of claim 1 wherein the defoamer comprises an alkali or alkaline earth metal salt of a fatty acid.

10. A liquid food grade rinse agent composition comprising approved food additive ingredients, suitable for dilution to form an aqueous rinse, the composition comprising:

(a) about 5 to 40 wt-% of a nonionic block copolymer composition, having the formula $(EO)_x$ $(PO)_y$ $(EO)_z$ with a molecular weight between 10,000 and 15,000, wherein x is 30 to 130, y is 30 to 70, z is 30 to 130 and x+y is ≧60, having a cloud point, measured with a 1 wt-% aqueous solution, greater than 100° C.;

(b) about 0.5 to 20 wt-% of a defoamer selected from the group consisting of a polydialkylsiloxane and a fatty acid ester of glycerol;

(c) about 0.05 to 1 wt-% of a water soluble carboxylic acid compound; and (d) about 40 to 95 wt-% of a water.

11. The composition of claim 10 wherein the water soluble carboxylic acid comprises benzoic acid, sorbic acid or mixture thereof.

12. The composition of claim 10 wherein the composition also comprises a 0.1 to 1.0 wt-% of a thickener.

13. A cast solid food grade rinse agent composition, suitable for dilution to form an aqueous rinse, the composition comprising:

(a) about 1 to 25 wt-% of a nonionic block copolymer composition, having the formula:

$$(EO)_x\ (PO)_y\ (EO)_z$$

with a molecular weight between 10,000 and 15,000, wherein x is 30 to 130, y is 30 to 70, z id 30 to 130 and x+y is ≧60, having a cloud point, measured with a 1 wt-% aqueous solution, of greater than 100° C.;

(b) about 1 to 25 wt-% of a food additive defoamer composition; and (c) about 5 to 80 wt-% of a water soluble casting agent diluent.

14. The composition of claim 13 wherein the casting agent comprises a polyalkylene glycol.

15. The composition of claim 13 wherein defoamer comprises a silicone defoamer.

16. The composition of claim 15 wherein the defoamer cemprises a combination of polydimethylsiloxane and silica at a ratio of about 1 to 200 parts by weight of a polydimethylsiloxane per each 100 parts by weight of a silica gel.

17. The composition of claim 13 wherein the defoamer comprises a fatty acid defoamer.

18. The composition of claim 17 wherein the fatty acid defoamer comprises a metallic salt of a fatty acid.

19. The composition of claim 17 wherein the fatty acid defoamer comprises a fatty acid ester of glycerol.

* * * * *

UNITED STATES PATENT AND TRADEMARK OFFICE
CERTIFICATE OF CORRECTION

PATENT NO. : 5,589,099 PAGE 1 of 2

DATED : December 31, 1996

INVENTOR(S) : Burton M. Baum

It is certified that error appears in the above-identified patent and that said Letters Patent is hereby corrected as shown below:

On column 4, line 34, please delete "copolymer" and substitute therefore --copolymers--

On column 5, line 20, please delete "Substance" and substitute therefore --Substances--

On column 5, line 61, please insert --as-- before the word "glucose"

On column 5, line 62, please delete "carbonates" and substitute therefore --carbonate--

On column 7, line 7, please insert --a-- before the word "distribution"

On column 8, line 17, please insert --that-- after the word "illustrate"

On column 8, line 25, please insert --that-- after the word "show"

On column 8, line 50, please delete "wt.-5" and substitute therefore --wt.-%--

UNITED STATES PATENT AND TRADEMARK OFFICE
CERTIFICATE OF CORRECTION

PATENT NO. : 5,589,099 PAGE 2 of 2

DATED : December 31, 1996

INVENTOR(S) : Burton M. Baum

It is certified that error appears in the above-identified patent and that said Letters Patent is hereby corrected as shown below:

On column 9, line 37, please delete "1 KAB" and substitute therefore --1-KAB--

On column 10, line 29, please delete "inches"

On column 13, line 45 (claim 7), please delete "aleroamer" and substitute therefore --defoamer--

On column 14, line 43 (claim 16), please delete "cemprises" and substitute therefore --comprises--

Signed and Sealed this

Twentieth Day of January, 1998

*Attest:*

*Attesting Officer*

BRUCE LEHMAN

*Commissioner of Patents and Trademarks*